US007744153B2

(12) United States Patent
Gentry et al.

(10) Patent No.: US 7,744,153 B2
(45) Date of Patent: Jun. 29, 2010

(54) THERAPEUTIC SEAT BACK INSERT

(75) Inventors: Bryan K. Gentry, Chattanooga, TN (US); Lewis Dorsey Cox, Leeds, AL (US)

(73) Assignee: The Gentry Collection, Chattanooga, TN (US)

( * ) Notice: Subject to any disclaimer, the term of this patent is extended or adjusted under 35 U.S.C. 154(b) by 0 days.

(21) Appl. No.: 11/942,925

(22) Filed: Nov. 20, 2007

(65) Prior Publication Data

US 2009/0127895 A1 May 21, 2009

(51) Int. Cl.
*A47C 31/00* (2006.01)

(52) U.S. Cl. ..... 297/180.1; 297/180.11; 297/180.15

(58) Field of Classification Search ..... 297/180.1, 297/180.11, 180.15
See application file for complete search history.

(56) References Cited

U.S. PATENT DOCUMENTS 2,976,700 A * 3/1961 Jackson ..... 62/313
4,060,276 A * 11/1977 Lindsay ..... 297/180.11
4,783,866 A * 11/1988 Simmons et al. ..... 5/639
4,793,651 A * 12/1988 Inagaki et al. ..... 297/180.11
4,858,259 A * 8/1989 Simmons et al. ..... 5/644
4,887,326 A * 12/1989 O'Brien et al. ..... 607/109
5,168,590 A * 12/1992 O'Sullivan ..... 5/490
5,393,462 A * 2/1995 Avery ..... 516/102
5,545,199 A * 8/1996 Hudson ..... 607/109
5,702,153 A * 12/1997 Pliska ..... 297/256.16
5,833,309 A * 11/1998 Schmitz ..... 297/180.11
5,916,088 A * 6/1999 Gueli ..... 5/639
6,007,572 A * 12/1999 Baldwin ..... 607/114
6,042,604 A * 3/2000 Gennetti ..... 607/108
6,804,845 B2 * 10/2004 Stewart et al. ..... 5/632
6,848,746 B2 * 2/2005 Gentry ..... 297/380
D512,232 S * 12/2005 Wu ..... D6/366
7,156,465 B2 * 1/2007 Stewart et al. ..... 297/411.36
D540,578 S * 4/2007 Chen ..... D6/502
D552,857 S * 10/2007 Wang ..... D6/366
D558,492 S * 1/2008 Lu ..... D6/500
7,344,196 B2 * 3/2008 Rodriquez ..... 297/452.41
2003/0032996 A1 * 2/2003 Hallman ..... 607/108
2004/0247528 A1 * 12/2004 Schoneberg ..... 424/40
2006/0143830 A1 * 7/2006 Bair ..... 5/630

* cited by examiner

*Primary Examiner*—Laurie K Cranmer
(74) *Attorney, Agent, or Firm*—Stephen J. Stark; Miller & Martin PLLC

(57) ABSTRACT

A thermal pack as utilized with an insert to direct at least one of heat and cooling through an open mesh back chair. Additional features may include pillow with a pocket, or a bracket configured to place the thermal pack at least in an effective thermal transfer range at a reverse side of the back portion of an open mesh chair. The insert may consist in providing at least some lumbar support in some embodiments.

17 Claims, 6 Drawing Sheets

92
90
96
94
98
112

104
106
108
102
100
114
110
90

122
120
124
126

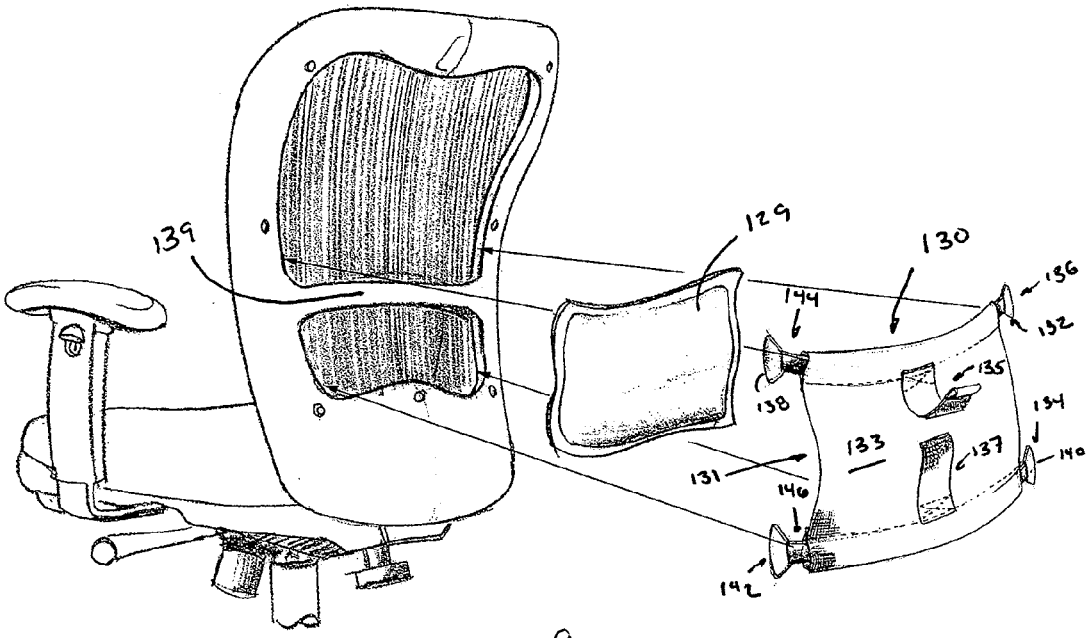
FIG 9
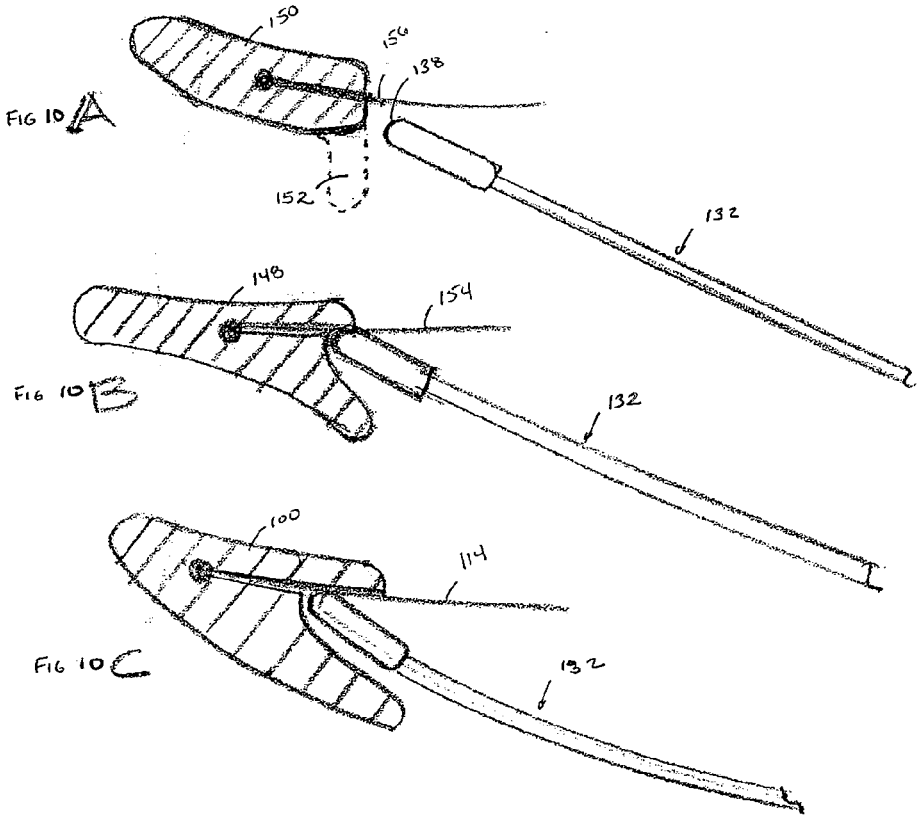
FIG 10A
FIG 10B
FIG 10C

201

200
202
198
200

THERAPEUTIC SEAT BACK INSERT

FIELD OF THE INVENTION

The present invention relates to an improved therapeutic seat back construction and more particularly to a removable insert which cooperates with mesh-backed chairs to facilitate heat transfer intermediate a thermal pack and a back of a user of the chair.

DESCRIPTION OF RELATED ART

Numerous attempts have been made to heat and cool in various ways and forms the back of a person sitting in a seat such as a chair. U.S. Pat. No. 6,164,719 shows a system for ventilating the seat causing an exchange of air on the seat surface directed at a user of a chair. U.S. Pat. No. 7,201,441 shows a similar type construction.

U.S. Published Patent Application No. 2004/0075311 shows an outdoor style folding chair with cooling pocket(s) at the back which receives ice in a pouch along the cloth back. The pockets are described having holes so that the melting ice can leak out onto the ground. While this might be an attractive option for cooling the middle of a persons back when outside, it leaves much to be desired in the context of an office environment. Cooling the lower back of a person with this style chair is also not possible, only a middle of the back.

Additionally, there are various designs of open mesh backed chairs such as those described in U.S. Pat. No. 7,063,677 and Design patent D512,232 or other chair configurations, but these do not provide cooling and/or heating capabilities.

SUMMARY OF THE INVENTION

It is an object of at least one embodiment of the present invention to provide an ability to provide heating or cooling through a therapeutic pad to a lower back portion of a person sitting in a chair and more particularly in a preferred embodiment, to a person sitting in an office chair through an open mesh fabric and/or back such as a back having plastic with holes therethrough giving rise to a porosity of at least 10% if not 30% or more.

It is another object of at least one embodiment of the present invention to provide an improved heated or cooled lower back portion for a chair.

It is another object of at least one embodiment of the present invention to provide a heated and/or cooled indoor chair having a lumbar supported back portion for at least one embodiment of a presently preferred embodiment of the present invention.

It is another embodiment at least in the present embodiment of the present invention to provide a removable therapeutic device for use with chairs, preferably through an open mesh fabric and/or back.

Accordingly, in accordance with the presently preferred embodiment of the present invention, an insert is preferably removably attachable and detachable relative to a reverse side of a back portion of a chair. The preferred chair has an open mesh fabric there across. The insert in the preferred embodiment has a retainer with a pocket which receives a heated or cooled thermal pad such as a gel pack. The retainer could be a pillow or other structure placed within the frame of a chair supporting the back disposing the gel pack and/or pocket towards the mesh back so that when a user uses the chair, that user's back contacts the open mesh back which is in thermal contact or at least within an effective thermal range with the pocket and/or gel pack thereby providing a conduit for the transfer of heat or cold.

In some of the open mesh office chair styled chairs, a cavity is formed by the framework of the chair back to provide somewhat of a natural holder for this insert. However, in other chair embodiments, other retention mechanisms may be employed which may possibly improve the effective contact surface area of thermal benefit to the user. The thermal pad may be removed from the insert for microwaving for heat therapy or otherwise heating and/or for putting in the freezer or refrigerator or otherwise cooling for cooling therapy. In fact, more than one thermal pad may be provided with each insert so that one pad may be in the microwave or cooler while another is in use. In still further embodiments, the insert may have an inflatable portion to further provide at least some lumbar support to a user of the chair or even vibrate to assist in relaxing muscles of a user. An insert may be sold together with the chair or separately therefrom or in parts for use by an end consumer.

BRIEF DESCRIPTION OF THE DRAWINGS

The particular features and advantages of the invention as well as other objects will become apparent from the following description taken in connection with the accompanying drawings in which:

FIG. 4A shows a back plan view of the insert embodiment prior to installation on the chair of FIG. 4;

FIG. 4B is an exploded view of the insert shown in FIG. 4A;

FIG. 4C is a top plan view of the exploded view shown in FIG. 4A in relationship to the wings of the chair shown in FIG. 3;

FIG. 4D is a back plan view of an alternative embodiment of a retainer as could be utilized with the shell of the insert shown in FIG. 4A and FIG. 4E as yet another embodiment of a retainer that could be utilized with a shell of the insert shown in FIG. 4A;

FIG. 9 is an exploded view of a fourth alternative embodiment as could be used with a chair;

FIGS. 10A-C are cross sectional view as taken along the line A-A in FIG. 1 with the alternative embodiment of FIG. 9 being utilized with various frame and mesh back constructions;

DETAILED DESCRIPTION OF THE EMBODIMENT

Figure 1:
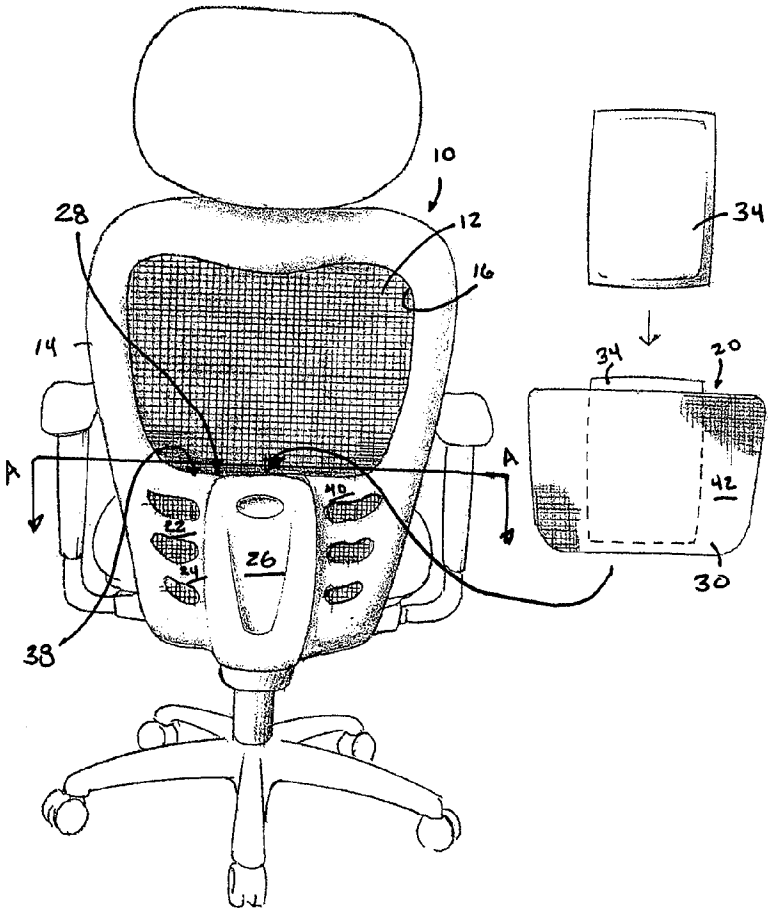
FIG. 1 is a back plan view of a chair prior to the installation of the insert of a presently preferred embodiment of the present invention with portions of a thermal treatment pack shown in phantom when installed in the insert.

FIG. 1 shows a chair 10. This chair 10 has a mesh back portion 12 which is retained by a frame 14. The frame 14 has an inner perimeter 16 to which the mesh 12 is connected thereto and supported thereby such that the mesh 12 back may provide a certain amount of resiliency and comfort to the user of the chair 10. This type chair construction has been produced in many embodiments by many manufacturers. The mesh 12 preferably has at least 10% porosity and possibly up to 30 or 50% or more porosity as created by the openings through the mesh fabric as would be understood by one of ordinary skill in the art. Chair fabrics like that shown in published application No. 2004/0075311 are not mesh fabric.

The chair 10 is shown prior to installation of an insert 20 of a presently preferred embodiment. The frame has a series of ribs 22, 24 connected to a spine 26 which at least partially assist in defining a cavity 28 between the mesh back 12 and the spine 26 and/or the ribs 22, 24 and the like. Other chair configurations may or may not have portions of this or other structure behind the mesh back 12.

Insert 20 may or may not have a pillow portion 30 and a pocket portion 32 which may be integral or otherwise provided relative to pillow 30 and a temperature or thermal pack or pad such as a gel pack 34 which can be subjected to at least one of heating and cooling such as heating in a microwave and/or cooling in a cooler such as a refrigerator or freezer. Gel packs are re-usable and contained (i.e., the contents do not leak out when they go from frozen to liquid under normal operating conditions). The pocket 32 and gel pack 34 may be sized as desired for a particular application but the applicant has found that the gel pad 34 is of sufficient width to cover the spine of the user and extend out somewhat further such as two to four inches or more to each side of a user's spine or so has been effective to provide sufficient heat and/or cooling as will be explained in further detail below. Gel packs 34 relatively slowly exchange heat; they are often frozen when cooled.

A pillow portion 30, if utilized, may be inflatable or not depending upon the particular embodiment, but preferably selected in terms of resiliency and thickness especially when utilized in combination with the cavity 28 to provide at least some lumbar support at a lower portion of a user's spine and slightly thereabove. This additional support may not normally provided with a frame 14 and mesh back 12 as the frame 14 can provides all of the tension for the mesh back 12. There may not normally be contact locations along a reverse side of the mesh back 12. As can be seen in reference to FIGS. 3, 5 and 7, the pillow portion 30 is located in the cavity 28 and is shown contacting a reverse side of mesh 12 such as along front of pocket 32 through which heat transfer either into or out from the thermal pack 34 may be achieved through the back of a user when utilizing the chair 10 from effective thermal transfer range. Front of pocket 32 may or may not be a mesh fabric depending upon the embodiment at issue.

Although the pillow 30 is shown completely disposed within the cavity 28, this need not be the case as it could stand above the upper portion 38 of shoulder 40 which may be the uppermost portion of the spine and rib structure supporting the frame 14. See FIG. 16 for such an embodiment. Furthermore, the pocket and gel pack 32, 34 could be sized such as without a larger area of heat transfer for the user than is shown. Of course, the gel pack 34 could be smaller as could be the pocket 32 for a more direct application to a smaller area in other embodiments.

Pillow portion 30 in addition to possibly being constructed having various foam products therein surrounded by an outer covering 42 of various materials could have the form of an air bladder and have a pressure and/or volume control such as a filling and deflating valve as would be understood by one of ordinary skill in the art. A front of a pocket 32 preferably has at least some porosity at least in the preferred embodiment which may further assist in the heat transfer from the gel pack 34 to the back of the user when in use.

The presently preferred embodiment of the present invention has the insert 20 retained in the cavity 28 by at least one of the spine 26 and ribs 22, 24. Other chair embodiments may have different structure behind the frame 14 which can assist in the retention of the pack 34. Additionally, some embodiments could have connectors such as hook and loop connectors, snaps, and/or other connectors to locate insert 20 behind a mesh back 12 regardless of whether or not a spine 26 and/or ribs 22, 24 and/or a pillow 30 are provided with that particular chair embodiment. In fact, the pillow portion 30 may still provide at least limited lumbar support even if there is nothing behind the pillow portion 30 as it may at least provide the simulated appearance that support to a user.

Figure 2:
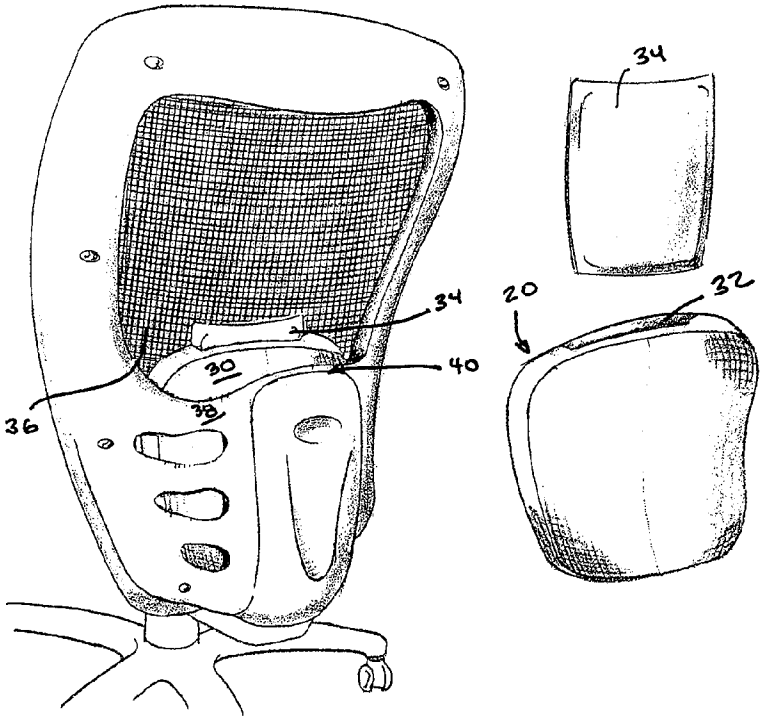
FIG. 2 is a back perspective view of the insert and gel pack as well as a portion of the chair portion as shown in FIG. 1 with the insert being installed with the gel pack.
Figure 3:
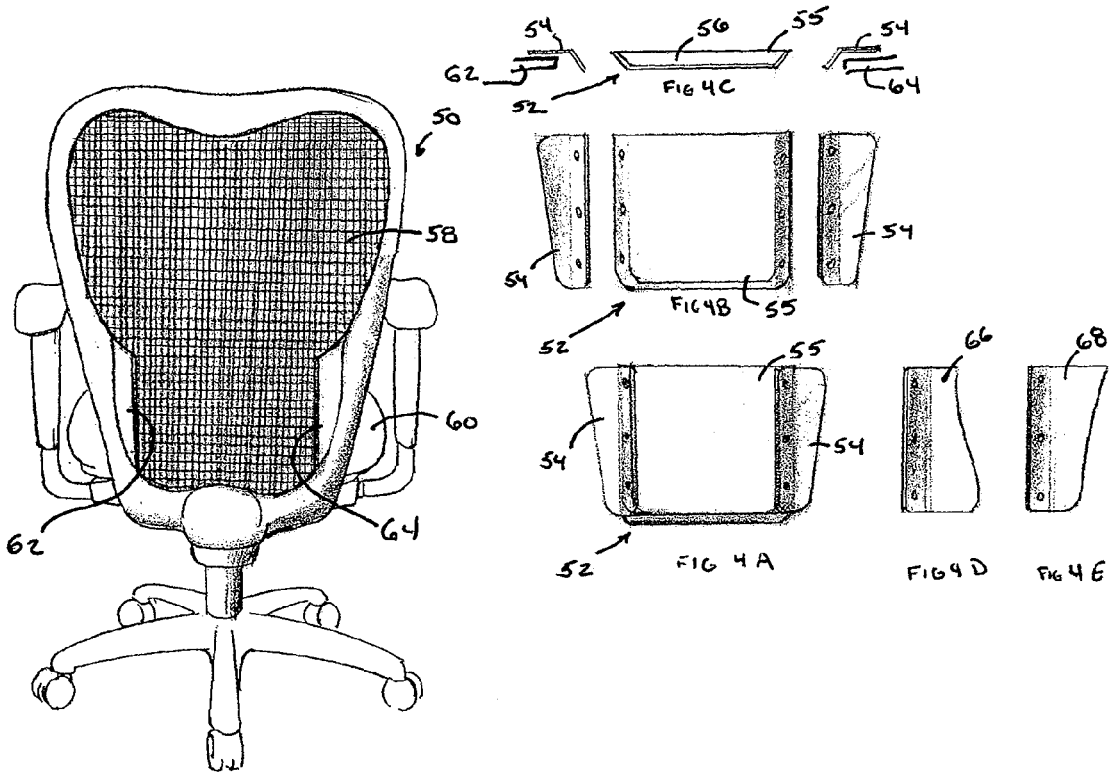
FIG. 3 shows a back plan view of an alternative chair embodiment prior to an insert of a first alternatively preferred embodiment installed.

FIG. 3 shows an alternate chair configuration 50 lacking the spine and rib construction of the chair in FIGS. 1-2. In this embodiment, an insert 52 as is shown. FIG. 4 may be utilized therewith various retains as will be described below. This insert 52 has one or more brackets or retainers 54 which in the embodiments shown in FIGS. 4A-D and 5 retains a gel pack 56 at least partially relative to the reverse side of mesh back 58 such as by wings 55 shown in FIGS. 3 and 4D. The retainer 54 appears to be a plastic or metal construction in this embodiment which connects to shell 55. When the user leans against the mesh back 58 while sitting on seat 60, the heat or coolness of the gel pack in shell pocket 56 serves to heat or cool the user of chair 50 through the mesh back 58 by being within an effective thermal transfer range.

The retainer(s) 54 contact one or more wings 62, 64 of chair 50 which may be used in retaining the insert 52 to the chair 50. Other connection mechanisms for retaining a gel pack in the shell pocket 56 relative to the retainers 54 cooperating with the wings 62, 64. Additionally, first and second alternative retainers 66, 68 are illustrated in FIGS. 4D and 4E depending upon the particulars of the chair 50. Of course, other or additional connection mechanisms could be utilized to at least assist in connecting the retainer(s) insert 52 to the chair 50. In fact, the applicant is researching the various dimensions of the most popular chairs with mesh backs 58 so that a limited number of cleats or retainers 54 may be provided to cooperate with what may prove to be various configurations as can be seen with the embodiments of FIGS. 7-14.

Figure 5:
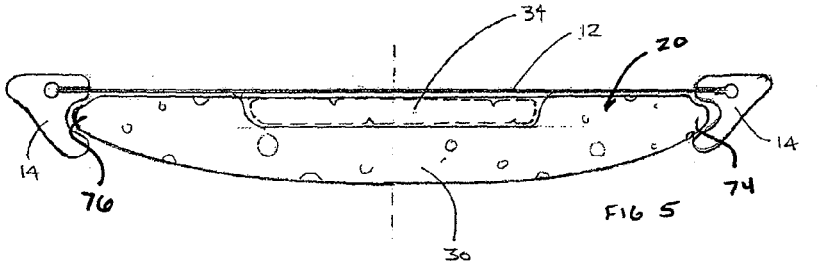
FIG. 5 is a top cross sectional view taken along the line A-A in FIG. 1 with the insert and thermal pack installed.

The thermal or gel pack 56 in this configuration may or may not provide lumbar support when utilized with a bracket 54 either with or independent of a separate pillow. Of course, in still other embodiments a pillow could be utilized as well. The gel pack 56 is shown in FIG. 5 can be easily seen downwardly inserted into the bracket 54 to be retained by lips 62 as would be understood by one of ordinary skill in the art. Other embodiments may function similarly and/or differently.

Figure 6:
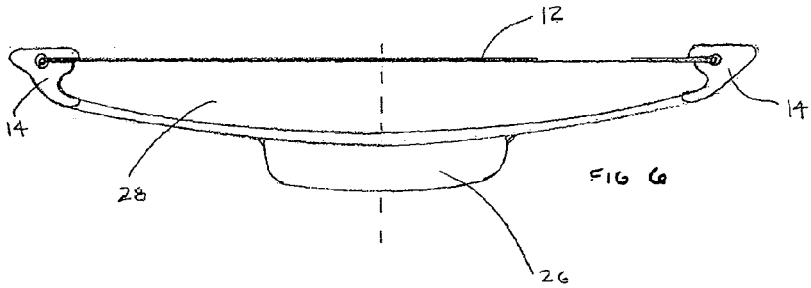
FIG. 6 is a top cross sectional view of the same cross section as shown in FIG. 2 with the insert removed.

FIG. 5 is a cross sectional view taken along line A-A of FIG. 1 showing the frame 14 assisting in retaining edges 74, 76 of pillow 30 or other portion of insert 20. In other embodiments, at least one bracket and/or retainer may assist in retaining the pack 34 in a desired relationship relative to the back of the user and/or the mesh back 12 to ensure that the thermal pack 34 is at a desired location for transmitting heat and/or coolness to a back of a user within a desired thermal transfer range. Pillow 30 may assist in reflecting and/or directing heat transfer through the mesh 12. In FIG. 6, the insert 20 has been removed and the cavity 28 is shown relative to the back 26 in the chair embodiments as reflected by FIGS. 1-2.

Figures 7A, 7B, 7C, 8:
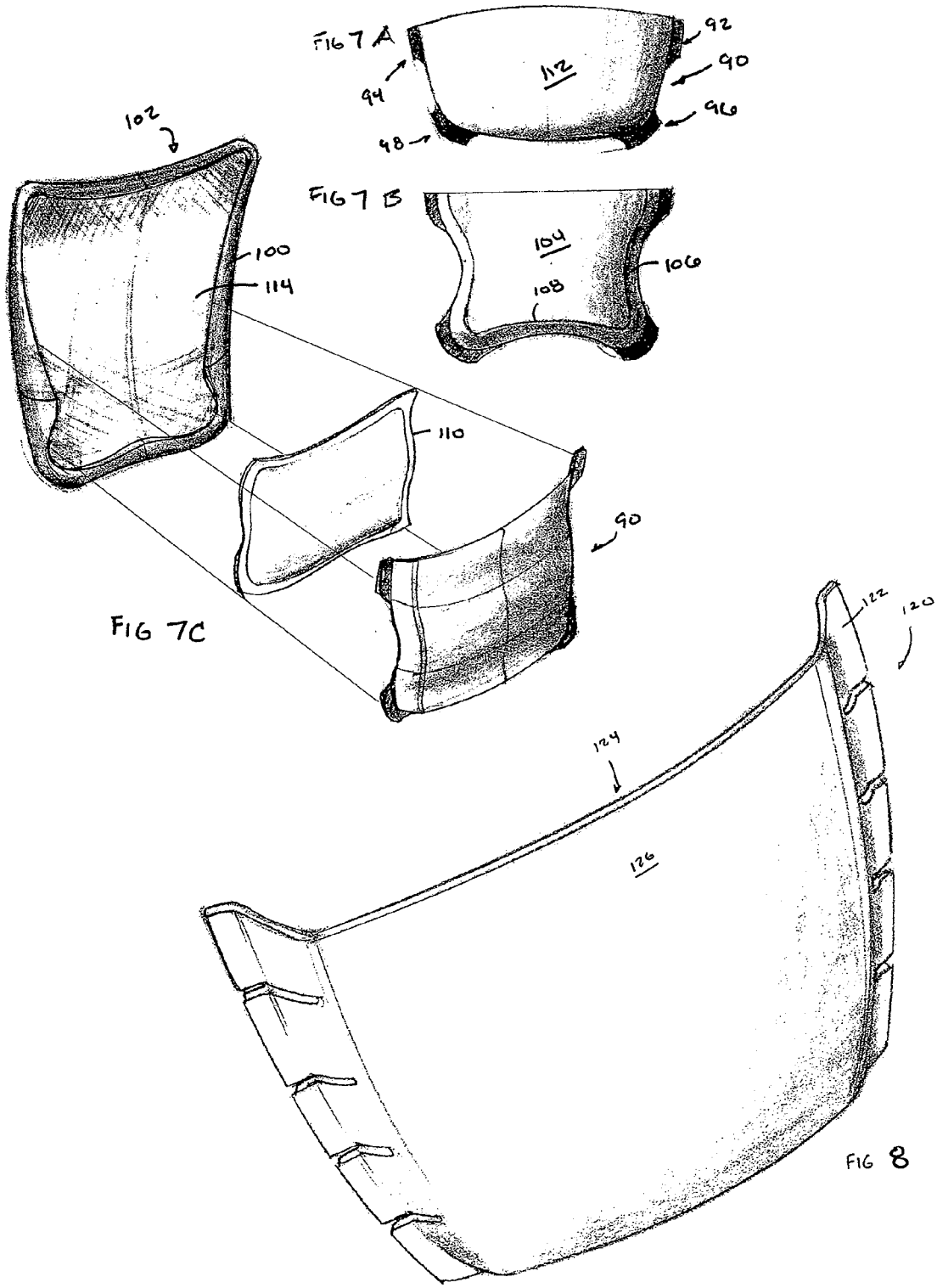
FIG. 7A is a plan back view of a second alternative embodiment of an insert.
FIG. 7B is a front plan view of the alternative embodiment of the insert as shown in FIG. 8.
FIG. 7C is an exploded view of the insert shown in FIGS. 7A and 7B utilized in conjunction with a thermal pack and a chair back.
FIG. 8 is a top elevational view of a third alternatively preferred embodiment of the embodiment shown in FIG. 7A-7C.

FIG. 7A shows a back plan view of an alternatively preferred embodiment of an insert 90 which insert has arms 92, 94 and legs 96, 98 back can be retained by frame 14 of chair back 102 with mesh 114 as shown in FIG. 7C. FIG. 7B shows a cavity 104 located internal to front face 106 which may define a lip at edge 108 which may assist in retaining thermal pack 110 relative to cavity 104. The insert 90 may have a hard shell 112 which may assist in directing heat through the mesh 114 of the chair back 102. After cooling or heating thermal pack 110 whether in or out of insert 90, the thermal pack 110 may be placed in the cavity 104 either before or after the insert 90 is located in the desired location relative to the chair back 102 as would be understood by one of ordinary skill in the art with reference to the drawings.

FIG. 8 shows an alternatively preferred insert 120 having a plurality of fingers 122 which may perform similarly or dissimilarly as the arms and legs 92, 94, 96, 98 of the insert 90 embodiment as shown in FIG. 7A. This construction has been found to provide an attractive insert 120 defining a cavity 124 internal to shell 126 when installed relative to a chair back.

FIG. 9 shows yet another embodiment of an insert 130 having retainers 132, 134 which are somewhat akin to battens in that they have ends 136, 138, 140, 142 respectively disposed on resilient members 132, 134 so that ends 136, 138, 140, 142 can be located on the frame and/or mesh such as is shown and described with reference to FIGS. 10A-C below.

FIGS. 10A, 10B and 10C show different ways that the battens 132, 134 can be installed relative to different frame cross sections 100, 148 or 150. Batten 132 is illustrated, but one skilled in the art would understand that batten 134 or any other of batten or other retainer or and/or shell 126 integral or independent from the retainers such as battens 132 illustrated in FIGS. 10A-10C could be disposed as shown to connect the insert 130 (or other embodiment) to the back of a chair. The ends 136, 138, 140, 142 are represented by end 138 in the illustrations with end 138 being directed against the frame 150 and/or the mesh back 114 in FIG. 10A. Optional extension 152 may assist in retaining the end 138 of the batten 132 (or 134, or other structure, not shown).

FIG. 10B shows an alternative of cross section of frame 148 with a mesh back 154. FIG. 10C shows yet another cross sectional frame 100 with mesh back 118 utilized in conjunction with the back 132. Other frame cross sections as would be understood by those of ordinary skill in the art may operate somewhat similarly or differently with retainers or battens.

Figure 11:
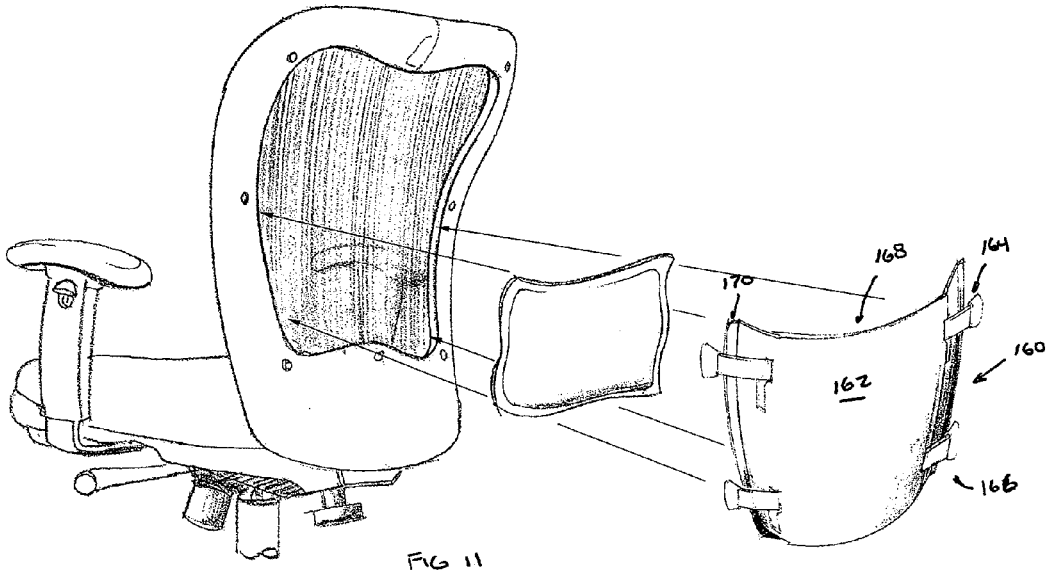
FIG. 11 is an exploded view of a fifth alternative embodiment.

FIG. 11 shows another embodiment of an insert 160. This insert has a shell 162 connected to battens 164, 166 and can operate somewhat similarly to that construction shown in FIGS. 9 and 10A-C. However, a cavity 168 may be formed with the shell 162 with its leading edge 170 contacting a rear surface of a mesh back (not shown) when installed whereas in FIG. 9, a pocket 131 is created with a more flexible membrane 133. A cross bar may be retained with connectors 135, 137 and/or battens 132, 134 may assist in retaining a thermal pack 129 as shown. Connectors 135, 137 may be used with or in place of battens 132, 134 and may take various configurations.

Figure 12A:
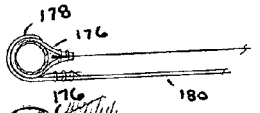
FIG. 12A is a cross sectional view of an attachment mechanisms in combination with a chair frame.
Figure 12B:
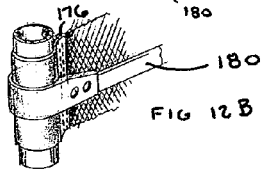
FIG. 12B is a cutaway view showing the connection of the embodiment of FIG. 12A connected to a frame of a chair.
Figure 12C:
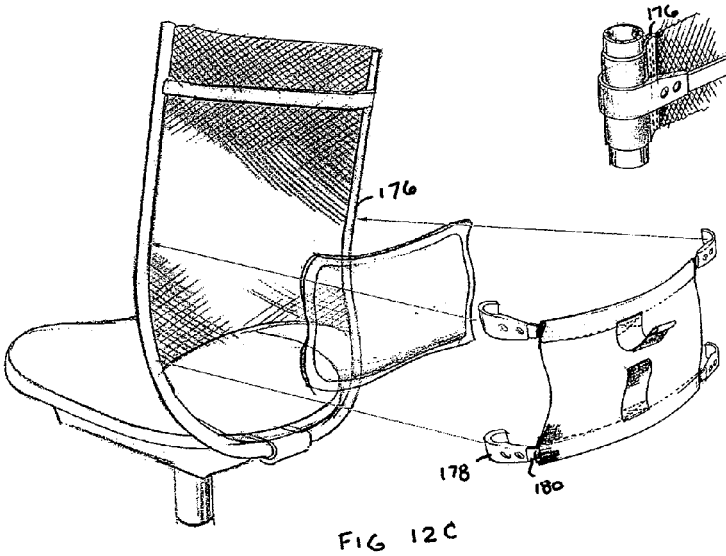
FIG. 12C is an exploded view of a sixth embodiment of an insert as could be connected to a chair frame as shown in FIGS. 12A and 12B.

Other inserts may be connected to other frames such as frame 176 as shown in FIGS. 12A-C. A catch 178 may be utilized in these varying embodiments such as with or without a resilient member 180 acting under tension as opposed to compression as have the battens such as 164, 166 shown in FIG. 11 are illustrated operating. The resilient members 180 can then be directed to the appropriate portion of a shell or casing such as fabric member 133 or shell 126 depending on the construction of the particular embodiment at hand. It may be further possible to directly connect a pillow or a thermal pack to the resilient member 180 or batten 164 depending on the particular embodiment. Resilient member 180 may be used with or in place of batten 164 in the various embodiments as one or more retainers.

Figures 13A, 13B, 13C:
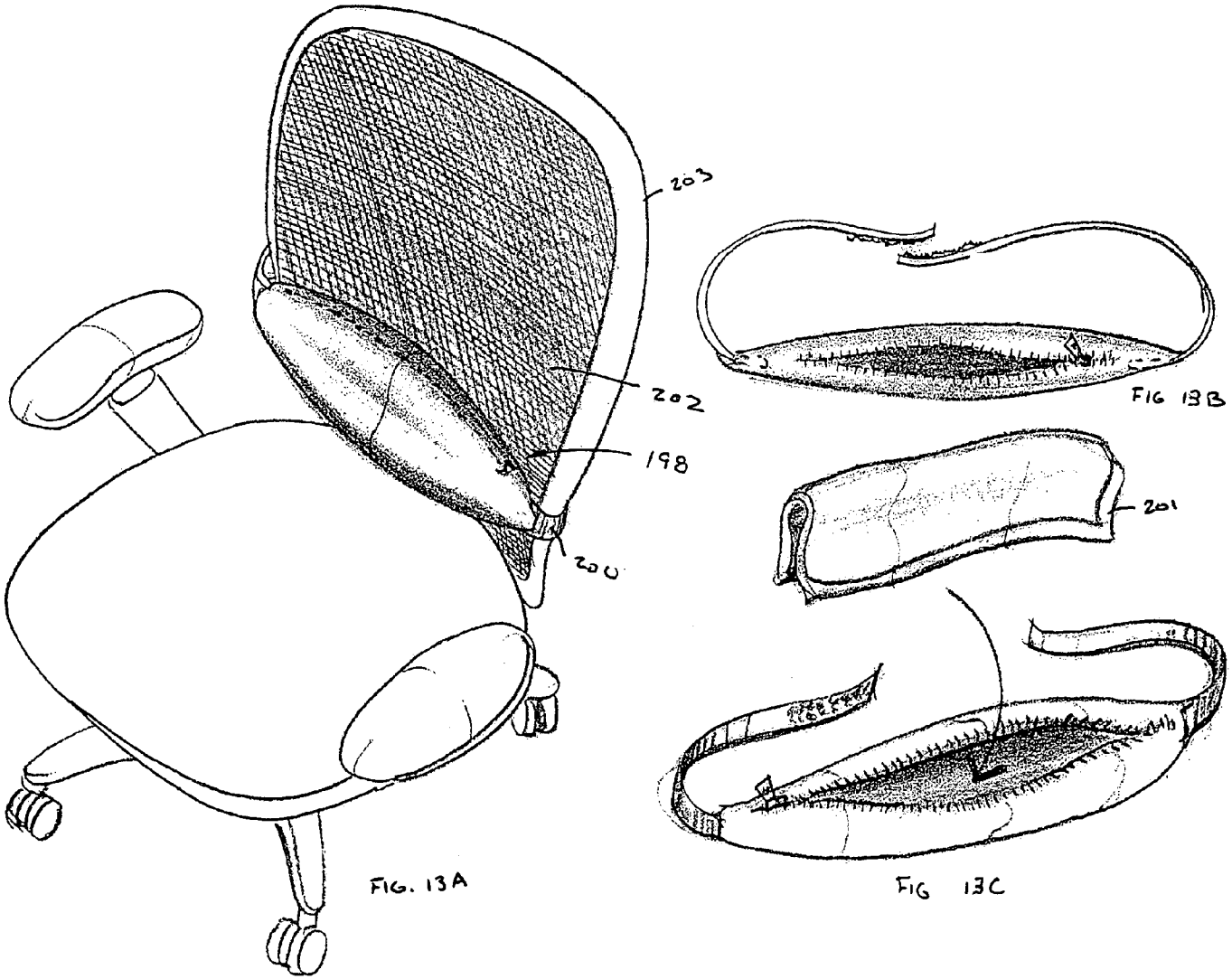
FIG. 13A is a top perspective view of a seventh embodiment shown in connection with a chair.
FIG. 13B is a top plan view of the insert of FIG. 13A removed from the chair.
FIG. 13C is an exploded view of the insert shown in FIG. 13A prior to installing the thermal pack and the insert.

In still further embodiments, the insert could be provided with connectors such as could connect about the ribs 22, 24, etc., or other appropriate structure on a chair to provide a location for a pillow 90 and/or gel pack to be disposed adjacent to a mesh back. Insert can have at least one pocket which receives cold pack therein. Pillow may fit within a pocket or may be disposed behind cold pack 201 as shown in FIG. 13B. The connectors when connected can affect the amount of pressure the pillow or cold pack 201 exerted against the back of the user by affecting the amount of lumbar support of the insert.

Lumbar support may also be provided in other ways such as is shown in FIGS. 13A-C. Insert 198 has straps 200 or other connection mechanisms to provide this insert disposed against the back of a patient intermediate the chair back 202 and the user. The strap 200 or other connector at least generally locates the lumbar in the insert 198 in a desired location. This insert preferably has a thermal pack 201 disposed therein and provides a covering 204 such as a mesh covering to allow the thermal transfer of heat therethrough to a user. A pillow may also disposed behind the thermal pack in this construction as is consistent with the other embodiments disclosed herein. Strap 200 connects to frame 203 as shown.

Finally, yet another embodiment utilized with the chair of FIG. 1 provides an insert equipped with a pillow having a massage controller coupled in internal massage elements such as a vibrating capability and/or kneading capacity. A thermal pack (not shown) is also disposed adjacent to the mesh back as occurred with the other embodiments. This embodiment provides the ability to provide hot or cold but also massage which is believed to be another novel feature. This embodiment is also shown at a higher elevation relative to the lower back than other embodiments such as to provide massage between shoulder blades of a user. This or other embodiments may be similarly located and/or extend at any portion or portions of a back of a user.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

Having thus set forth the nature of the invention, what is claimed herein is:

1. A therapeutic insert for use with chairs having backs comprising:

a removable insert having a resilient pillow, and a pocket portion disposed towards a front of the insert in front of at least a portion of the pillow;

a re-usable contained thermal pack removably inserted in the pocket portion toward the front of the insert, said thermal pack configured to be at least one of heated and cooled and then at least relatively slowly exchange heat;

a chair having a rigid structural frame connected to a center rigid spine and at least one rib extending from the spine and forming a cavity behind the chair back, and said chair back having a porosity of at least 30%;

wherein said insert is selectively placed in thermal transfer range of the chair back for transferring heat to a person from the thermal pack;

and the insert is securely connected to the structural frame of the chair.

2. The therapeutic insert and chair of claim 1 wherein the pocket of the pad has a mesh front.

3. The therapeutic chair insert and chair of claim 1 wherein the thermal pack is a gel pack.

4. A therapeutic insert for use with chairs having backs comprising:

a removable insert having a resilient pillow, and a pocket portion disposed towards a front of the insert in front of at least a portion of the pillow;

a re-usable contained thermal pack removably inserted in the pocket portion toward the front of the insert, said thermal pack configured to be at least one of heated and cooled and then at least relatively slowly exchange heat;

a chair having a rigid structural frame connected to a center rigid spine and at least one rib extending from the spine and forming a cavity behind the chair back, and said chair back having a porosity of at least 10%;

wherein said insert is selectively placed in thermal transfer range of the chair back for transferring heat to a person from the thermal pack; and wherein the insert is located in the cavity behind the chair back and presses against the chair back with the pillow at least assisting in providing a lumbar support on opposite sides of the thermal pack.

5. The therapeutic insert and chair of claim 4 wherein the chair back has an open mesh supported by the frame having an interior perimeter.

6. The therapeutic insert and chair of claim 5 wherein the insert is at least partially retained in position by the central spine in the cavity.

7. The therapeutic insert and chair of claim 5 wherein the lumbar support is at least partially retained in position by the at least one rib in the cavity.

8. A therapeutic insert for use with chairs having backs comprising:

a removable insert having a resilient pillow, and a pocket portion disposed towards a front of the insert in front of at least a portion of the pillow;

a re-usable contained thermal pack removably inserted in the pocket portion toward the front of the insert, said thermal pack configured to be at least one of heated and cooled and then at least relatively slowly exchange heat;

a chair having a rigid structural frame connected to a center rigid spine and at least one rib extending from the spine and forming a cavity behind the chair back, and said chair back having a porosity of at least 10%;

wherein said insert is selectively placed in thermal transfer range of a the chair back for transferring heat to a person from the thermal pack; and a rigid retainer securely connecting the insert to opposing sides of the frame of the open mesh chair back independently of at least one of a top and bottom of the chair back.

9. A method of applying at least one of hot and cold treatment to a back of a user comprising the steps of:

(a) providing a removable therapeutic insert having a front and a re-usable contained thermal pack disposed toward the front of the insert in front of one of a pillow and a shell;

(b) changing the temperature of the thermal pack by one of heating and cooling the thermal pack;

(c) locating the therapeutic insert with the thermal pack in an effective thermal transfer range of a reverse side of a back portion of a chair having a porosity of at least 10%; and (d) transferring heat through the back portion of an open mesh chair having a cavity defined at least in part with rigid members behind the back portion of the chair and the insert behind open mesh of the back portion of the chair, when installed while maintaining the thermal pack in the therapeutic insert with the one of the pillow and the shell assisting in directing heat transfer through the back portion with the thermal pack located intermediate the back portion and the one of the pillow and the shell, and the insert located in the cavity and contacting at least one of the rigid members.

10. The method of claim 9 further comprising the steps of:

removing at least the thermal pack and at least one of heating and cooling the thermal pack; and reinstalling the thermal pack in the insert relative to the reverse side of the back portion of the chair with at least a portion of the thermal portion extending from the insert.

11. The method of claim 10 wherein the thermal pack is removed with the insert relative to the back portion of the chair, and then removed from the insert prior to heating or cooling.

12. The method of claim 10 wherein the thermal pack is connected to the insert when reinstalled relative to the reverse side of the back portion of the chair.

13. The method of claim 10 wherein the insert has a pocket disposed toward the front of the insert and the thermal pack is removed from the pocket for the at least one of the heating and cooling step.

14. The method of claim 9 wherein the insert further comprises a retainer and further comprising the step of installing the retainer directly to side portions of a frame supporting the back portion of the open mesh chair wherein when the thermal pack is placed in the effective thermal range when located with the retainer with the retainer supporting the insert independently of the back portion of the open mesh chair.

15. The method of claim 9 wherein during the step of changing the thermal pack it is heated and then heat is transferred through the back portion of the open mesh chair to the user of the chair and after transferring at least some heat, the thermal pack is removed and cooled and then at least the thermal pack is located with the insert in the effective thermal transfer range to provide cooling through the back portion of the mesh chair.

16. A therapeutic chair insert connected to a chair comprising:

an insert having a front;

a chair having a chair back with a porosity of at least 10%;

a reusable thermal pack disposed toward the front of the insert, said thermal pack configured to be at least one of heated and cooled and then at least relatively slowly exchange heat with one of a pillow and a shell behind the thermal pack at least assisting in directing heat through the front of the insert; and a retainer connected to the insert for securely locating the insert at a desired location relative to sides a chair back, wherein the thermal pack is placed in a thermal transfer range for transferring heat to a person from the thermal pack, with the retainer connected to opposing sides of the chair back.

17. The therapeutic insert of claim 16 wherein the retainer is rigid and connects to the sides of the chair back supporting the insert.

* * * * *